US010889132B2

(12) United States Patent
Pertile et al.

(10) Patent No.: US 10,889,132 B2
(45) Date of Patent: Jan. 12, 2021

(54) MACHINE FOR DIGITAL PRINTING ON TAPE

(71) Applicant: UTECO CONVERTING S.P.A., Colognola ai Colli (IT)

(72) Inventors: Agostino Pertile, San Martino Buon Albergo (IT); Mauro Cattaruzza, Malo (IT); Stefano Russo, Folgaria (IT); Mario Gazzani, San Pietro in Cariano (IT)

(73) Assignee: UTECO CONVERTING S.P.A., Colognola ai Colli (IT)

( * ) Notice: Subject to any disclaimer, the term of this patent is extended or adjusted under 35 U.S.C. 154(b) by 0 days.

(21) Appl. No.: 16/305,985

(22) PCT Filed: May 29, 2017

(86) PCT No.: PCT/EP2017/062857
§ 371 (c)(1),
(2) Date: Nov. 30, 2018

(87) PCT Pub. No.: WO2017/207469
PCT Pub. Date: Dec. 7, 2017

(65) Prior Publication Data

US 2019/0210379 A1 Jul. 11, 2019

(30) Foreign Application Priority Data

May 31, 2016 (IT) ..... 102016000055944

(51) Int. Cl.
*B41J 11/00* (2006.01)
*B41F 13/02* (2006.01)
(Continued)

(52) U.S. Cl.
CPC ..... *B41J 11/002* (2013.01); *B41F 13/02* (2013.01); *B41F 19/007* (2013.01);
(Continued)

(58) Field of Classification Search
CPC ..... B41J 11/002; B41J 15/04; B41J 15/042; B41J 11/04; B41J 13/226; B41F 23/0479;
(Continued)

(56) References Cited

U.S. PATENT DOCUMENTS 5,383,288 A * 1/1995 Ilmarinen ..... D21F 5/00 34/119
5,634,402 A * 6/1997 Rudd ..... F26B 3/283 101/424.1

(Continued)

FOREIGN PATENT DOCUMENTS

WO 2015/030766 A1 3/2015

OTHER PUBLICATIONS

International Search Report dated Aug. 8, 2017 issued in PCT/EP2017/062857.

(Continued)

*Primary Examiner* — Yaovi M Ameh
(74) *Attorney, Agent, or Firm* — Scully, Scott, Murphy & Presser, P.C.

(57) ABSTRACT

A machine for digital printing on tape, which comprises a frame that supports elements of entraining at least one tape along an advancement path and is provided with at least one printing assembly, which comprises at least one ink-jet printing head; downstream of the printing assembly, along the advancement direction of the tape, there is at least one assembly for drying the inks applied to the tape; the drying assembly comprises a temperature-adjustable drum for supporting and entraining the tape, adhesion elements adapted to allow the retention in adhesion of the tape on the outer lateral surface of the drum, and hot air emitter elements which face at least one portion of the outer lateral surface of the drum.

16 Claims, 8 Drawing Sheets

(51) Int. Cl.

| | |
|---|---|
| ***B41F 19/00*** | (2006.01) |
| ***B41F 23/04*** | (2006.01) |
| ***B41J 11/04*** | (2006.01) |
| ***B41J 13/22*** | (2006.01) |
| ***B41J 15/04*** | (2006.01) |

(52) U.S. Cl.
CPC ..... *B41F 23/0413* (2013.01); *B41F 23/0426* (2013.01); *B41F 23/0436* (2013.01); *B41F 23/0479* (2013.01); *B41F 23/0483* (2013.01); *B41J 11/04* (2013.01); *B41J 13/226* (2013.01); *B41J 15/04* (2013.01); *B41J 15/042* (2013.01)

(58) Field of Classification Search
CPC .... B41F 13/02; B41F 19/007; B41F 23/0413; B41F 23/0426; B41F 23/0436; B41F 23/0483
See application file for complete search history.

(56) References Cited

U.S. PATENT DOCUMENTS

2010/0020148 A1* 1/2010 Gervasi ..... B41J 2/17593 347/99
2010/0149567 A1* 6/2010 Kanazawa ..... H04N 1/40006 358/1.9
2011/0205321 A1 8/2011 Kobayashi et al.
2013/0265359 A1* 10/2013 Sugaya ..... B41J 13/223 347/16
2015/0174924 A1* 6/2015 Fuchioka ..... B41J 11/002 347/102
2016/0014463 A1 1/2016 Paxinos et al.

OTHER PUBLICATIONS

Italian Search Report dated Jan. 30, 2017 issued in IT UA20163958, with partial translation.
European Third Party Observation dated Jul. 15, 2019 received in European Application No. 17727853.8.

* cited by examiner

MACHINE FOR DIGITAL PRINTING ON TAPE

The present invention relates to a machine for digital printing on tape.

Different printing technologies are known, such as, for example, flexographic, rotogravure, offset, digital and so on.

One type of digital printing is called ink-jet printing.

The inks used in ink-jet digital printing are water-based and not prone to evaporation, in order to facilitate the ejection of the droplet during printing and prevent clogging of the nozzles.

For ink-jet digital printing on paper, the low evaporability of the inks is not a limitation on printing speed, given the absorbent properties of paper.

However, for ink-jet digital printing on tape of substantially non-absorbent material, like plastic, aluminum and the like, the low evaporability of the inks constitutes a limitation on the printing speed.

In order to obtain the drying of the inks, current printing machines use drying devices, which typically use hot air projected at high speed on the tape to be dried, which is supported by a plurality of rollers that are mutually spaced apart.

The thermal changes and air turbulence found in these known drying devices can cause uncontrolled expansions and shifts of the tape, with consequent loss of printing precision.

The aim of the present invention is to provide a solution to the above mentioned drawbacks, by devising a machine for digital printing on tape that makes it possible, with respect to the known art, to print with high printing speed on tape made of non-absorbent materials or in any case materials with poor absorption of inks or of their water-based components, without penalizing the print quality and without having to modify the characteristics of the tape.

Within this aim, an object of the present invention is to provide a machine for digital printing on tape that makes it possible to use water-based inks or, in any case, inks containing water, without problems.

Another object of the present invention is to provide a machine for digital printing on tape that is structurally simple and which is also competitive from a purely economic viewpoint.

This aim and these and other objects which will become better apparent hereinafter are achieved by a machine for digital printing on tape, according to the invention, as defined in claim 1.

Further characteristics and advantages of the invention will become better apparent from the description of some preferred, but not exclusive, embodiments of the machine, according to the invention, which are illustrated, by way of non-limiting example, in the accompanying drawings wherein.

Figure 1:
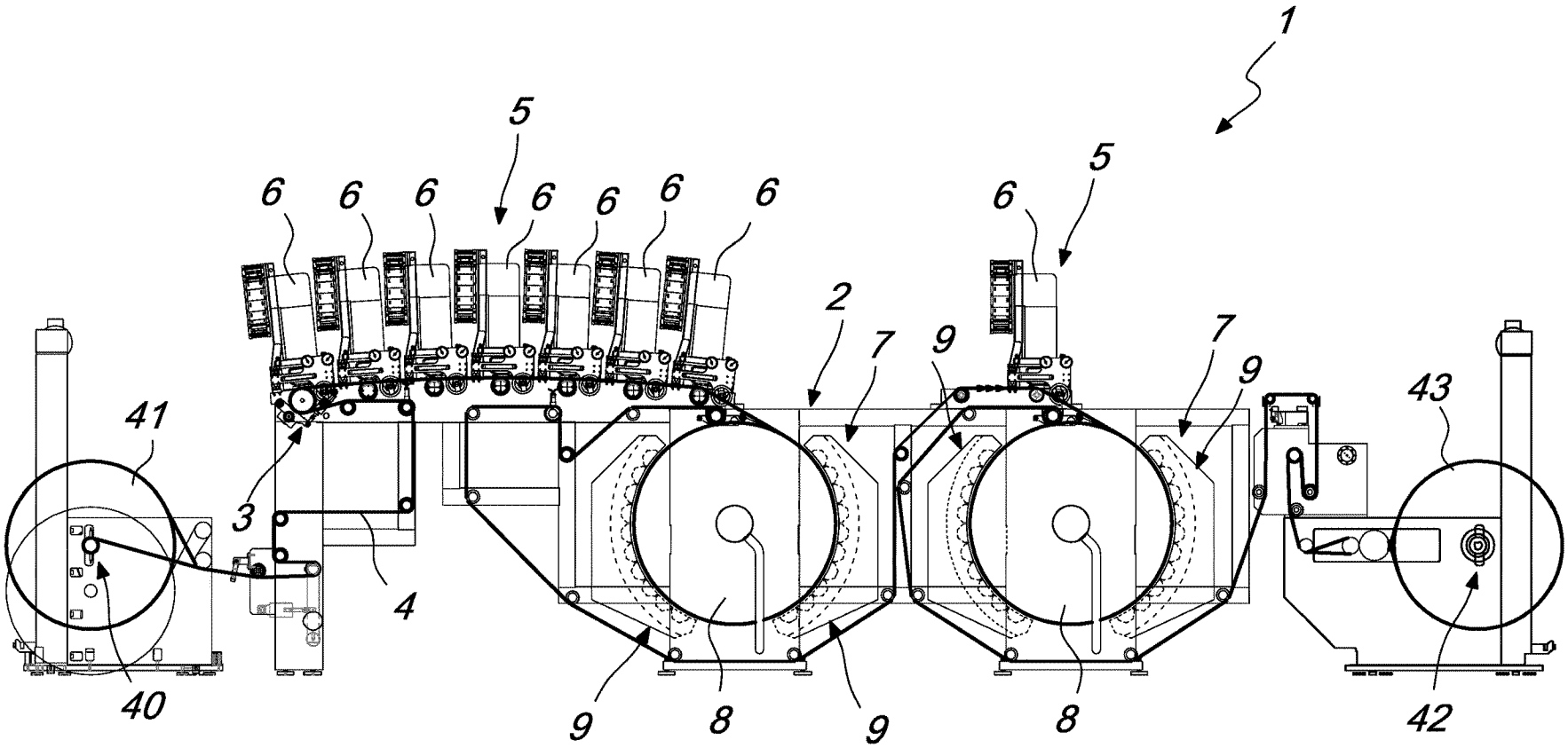
FIG. 1 is a side view of the machine according to the invention.

With reference to the figures, the machine for digital printing on tape, according to the invention, generally designated by the reference numeral 1, comprises a frame 2 that supports means 3 of entraining at least one tape 4 along an advancement path and is provided with at least one printing assembly 5, which comprises at least one ink-jet printing head 6.

Optionally, the (or each) printing assembly 5 can comprise a plurality of ink-jet printing heads 6, which are distributed along the advancement path of the tape 4.

In particular, the tape 4 can be made of a material that is substantially not capable of absorbing the inks applied by the printing assembly 5, such as, for example, polyethylene, polypropylene, polyester, aluminum and the like.

Downstream of the printing assembly 5, along the advancement direction of the tape 4, there is at least one assembly 7 for drying the inks applied to the tape 4 by the printing assembly 5.

The peculiarity of the invention consists in that the drying assembly 7 comprises a temperature-adjustable drum 8 for supporting and entraining the tape 4, with which adhesion means are associated that are adapted to allow the retaining in adhesion of the tape 4 to the outer lateral surface of the drum 8.

Also according to the invention, the hot air emitter means 9 are facing at least one portion of the outer lateral surface of the drum 8.

Advantageously, further, means 10 of aspirating the hot air emitted by the above mentioned emitter means 9 are facing at least one portion of the outer lateral surface of the drum 8.

Delving deeper into the details, the hot air emitter means 9 comprise means 11 of generating curtains of hot air 12, which are arranged on planes that are substantially radial with respect to the axis of the drum 8. In particular, the means 11 of generating curtains of hot air 12 are mutually angularly spaced apart about the axis of the drum 8.

Advantageously, the aspiration means 10 are interleaved between the means 11 of generating curtains of hot air 12, so as to allow a distributed evacuation of the water vapor produced as an effect of the heating of the inks by the hot air emitter means 9.

Conveniently, the emitter means 9 comprise a manifold 13 for feeding hot air that extends, advantageously, about at least one portion of the outer lateral surface of the drum 8 and which is connected, for example by way of a delivery duct 14, to a generator of hot air, not shown, of any conventional type.

In particular, the feeder manifold 13 is collected, at regular intervals along its extension, with the means 11 of generating curtains of hot air 12.

Figure 5:
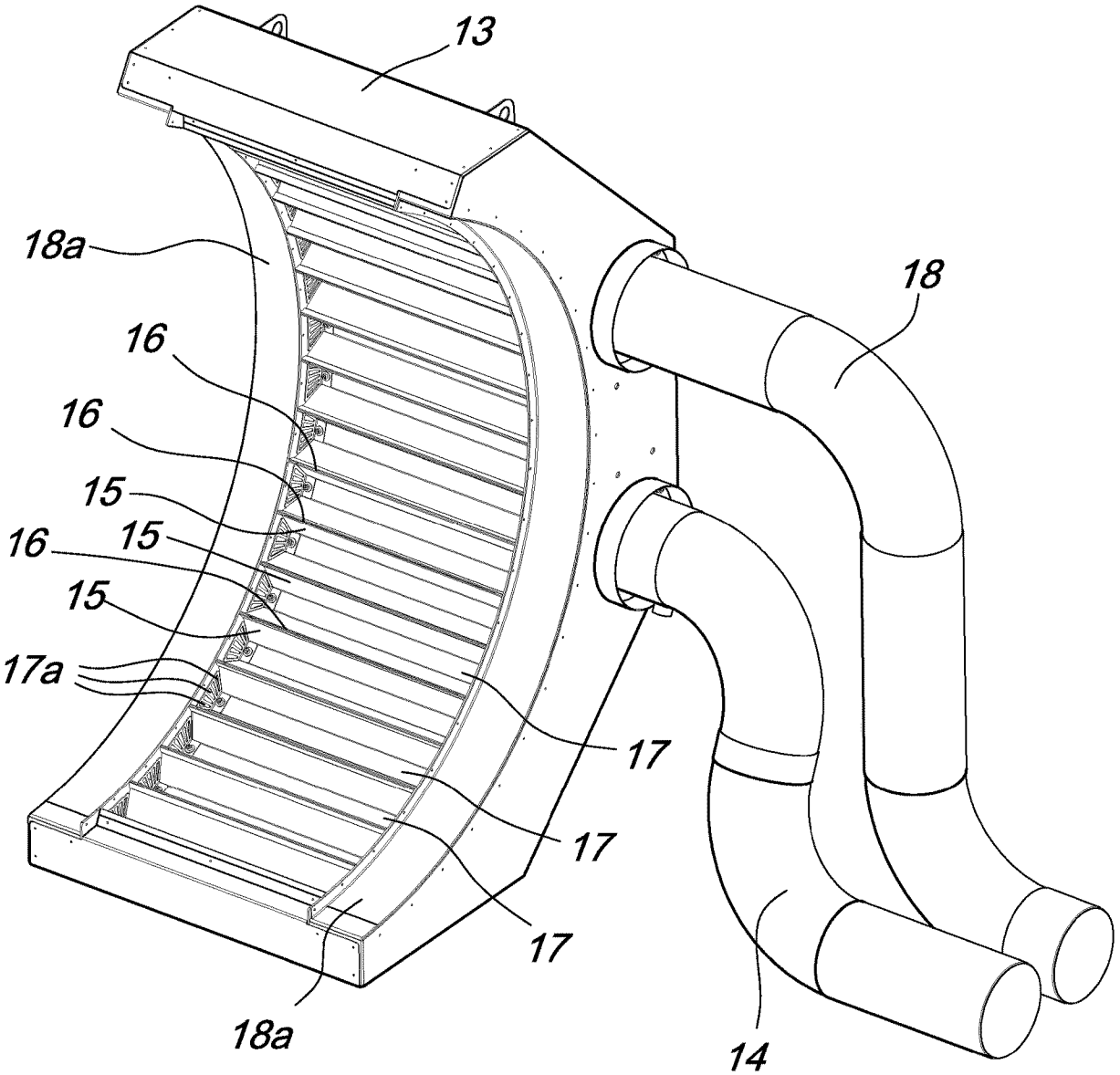
FIG. 5 is a perspective view of a detail of the machine according to the invention.
Figure 6:
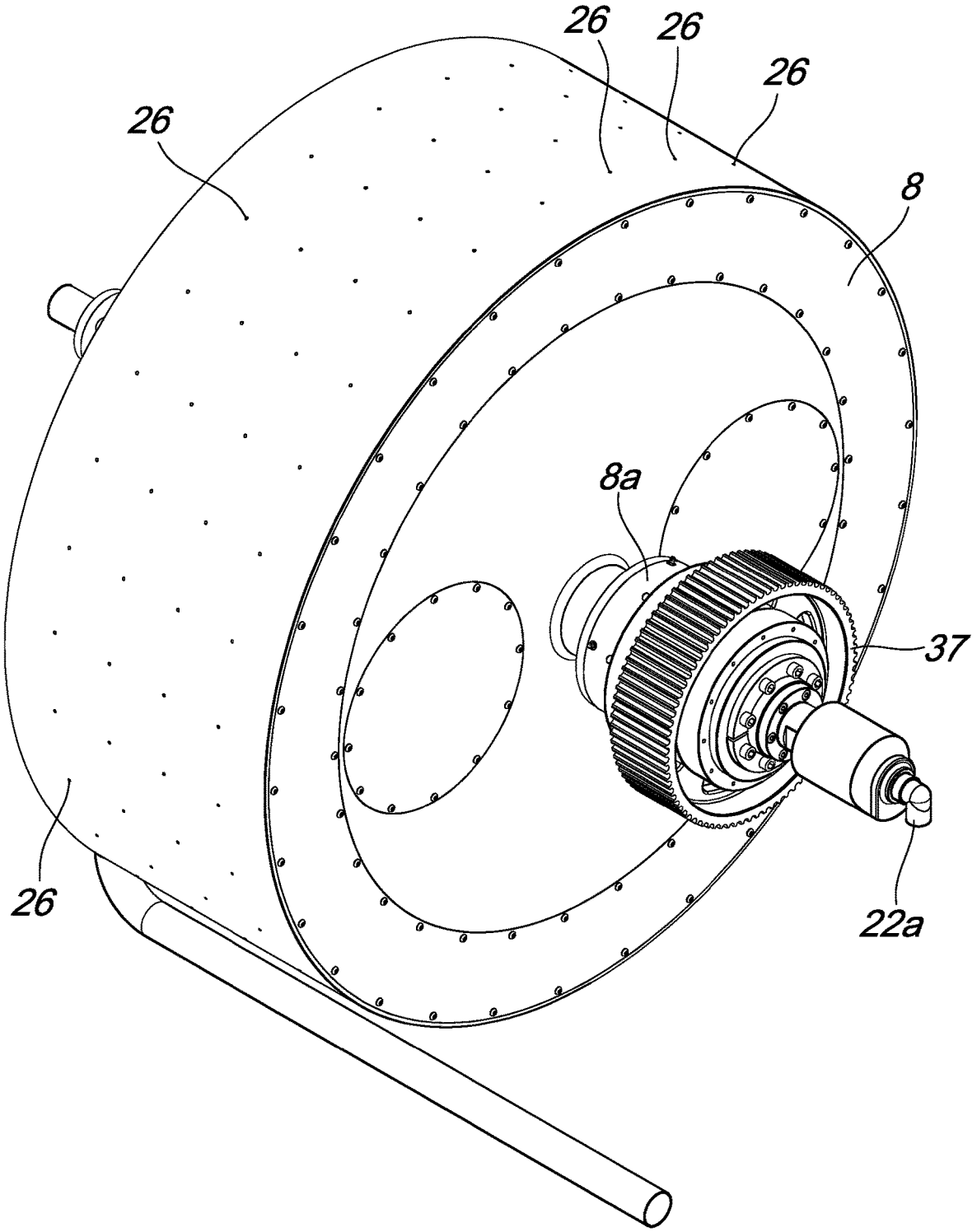
FIG. 6 is a perspective view of a drum belonging to the machine according to the invention.
Figure 7:
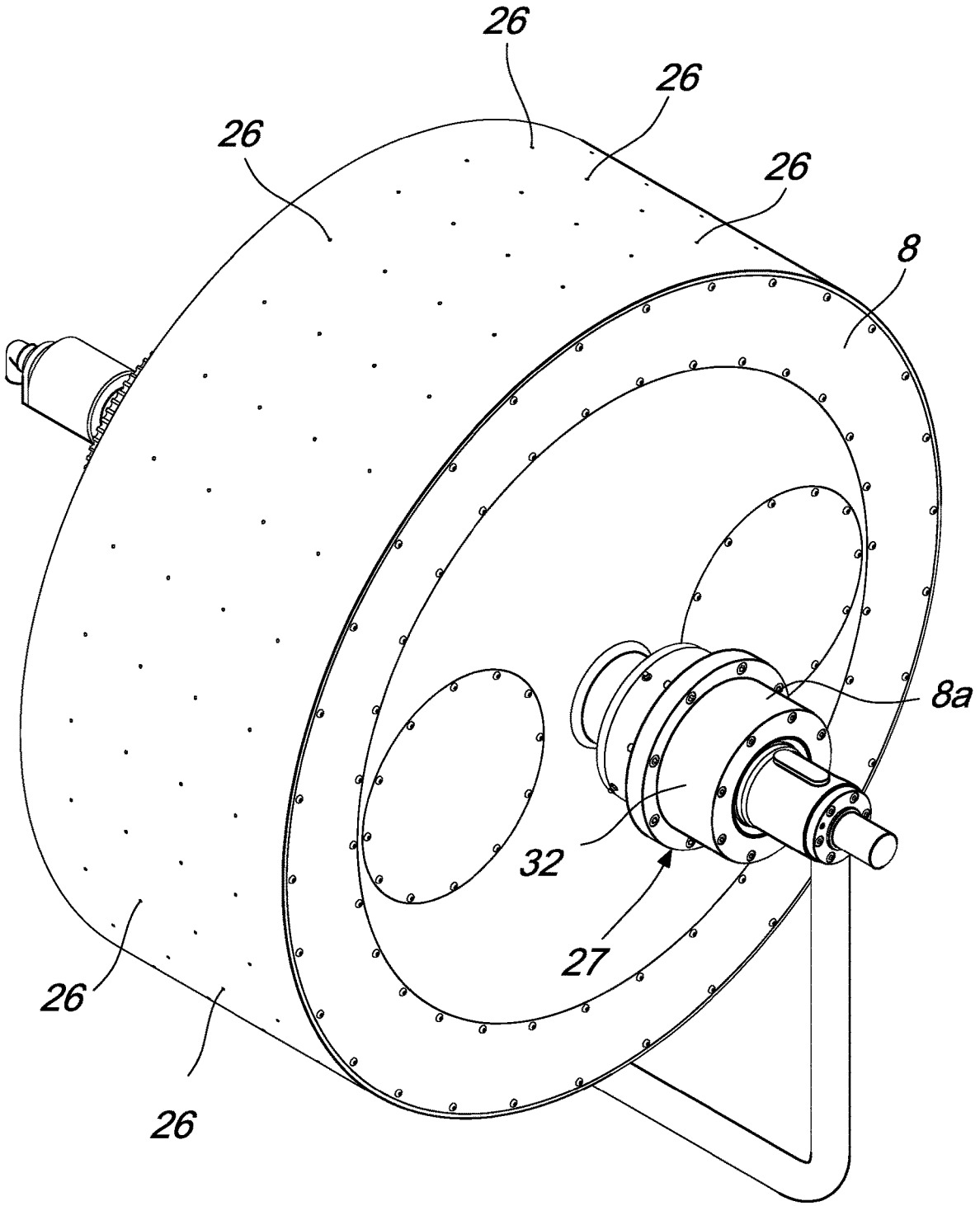
FIG. 7 is a perspective view of the drum seen from a different angle.

As illustrated in particular in FIG. 5, the means 11 of generating curtains of hot air 12 comprise a plurality of dispensers 15 that are mutually spaced apart about the axis of the drum 8 and are each provided with at least one respective blower slit 16 connected to the hot air feeding chamber 13.

In particular, the blower slits 16 of the dispensers 15 extend substantially parallel to the axis of the drum 8 and are facing the outer lateral surface of the drum 8.

Advantageously, the aspiration means 10 are provided by a plurality of aspiration hoods 17, which extend substantially parallel to the axis of the drum 8 and are interposed between the dispensers 15.

In particular, the aspiration hoods 17 are open toward the outer lateral surface of the drum 8 and are connected, conveniently at at least one of their longitudinal ends, to an aspiration fan, not shown. Alternatively, the aspiration hoods 17 can be connected to the aspiration fan at a central portion thereof.

In more detail, at each one of the relative longitudinal ends, the aspiration hoods 17 have air passage slots 17*a* which are connected to the aspiration fan, for example by way of a conventional aspiration duct 18, which is connected, as in the embodiment shown, to a pair of lateral conveyance channels 18*a*, which are connected, in turn, with the aspiration hoods 17 by way of the passage slots 17*a*.

As illustrated in particular in FIG. 5, the blower slits 16 can be defined, advantageously, in the space comprised between two corresponding mutually contiguous aspiration hoods 17, while the opposite longitudinal walls of the aspiration hoods 17 make it possible to provide sections for conveying air toward the blower slits 16 of the dispensers 15.

Figure 3:
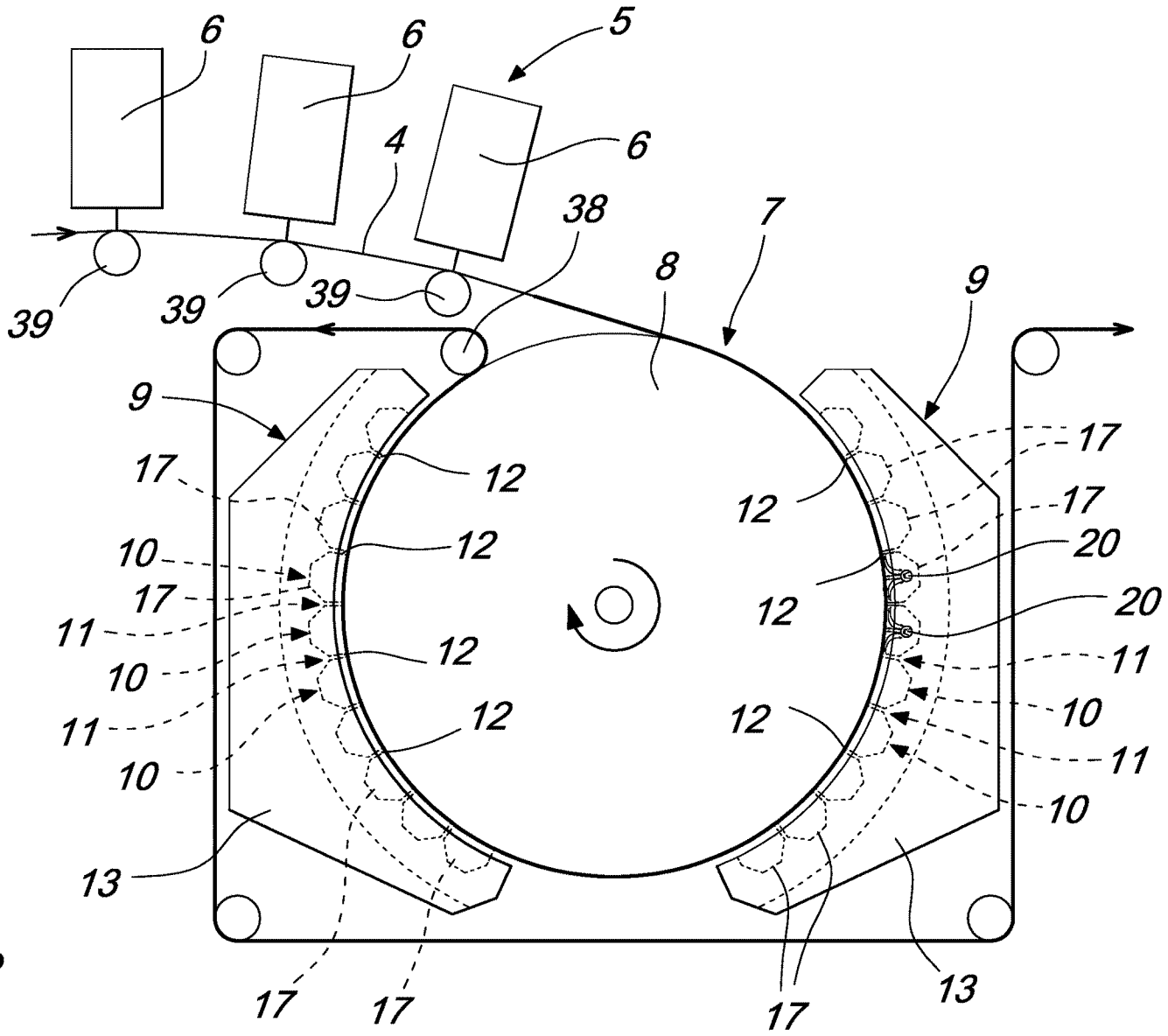
FIG. 3 is a schematic side view of a second embodiment of the same portion of the machine according to the invention.

Conveniently, as shown in FIG. 3, the drying assembly 7 can be, likewise, provided with heating means adapted to emit infrared radiation, so as to increase the efficacy of drying the inks.

In particular, such heating means comprise, conveniently, a plurality of infrared lamps 20, each one of which is, advantageously, arranged inside a respective aspiration hood 17, so that the air aspirated into the aspiration hoods 17 can cool the lamps 20.

Figure 8:
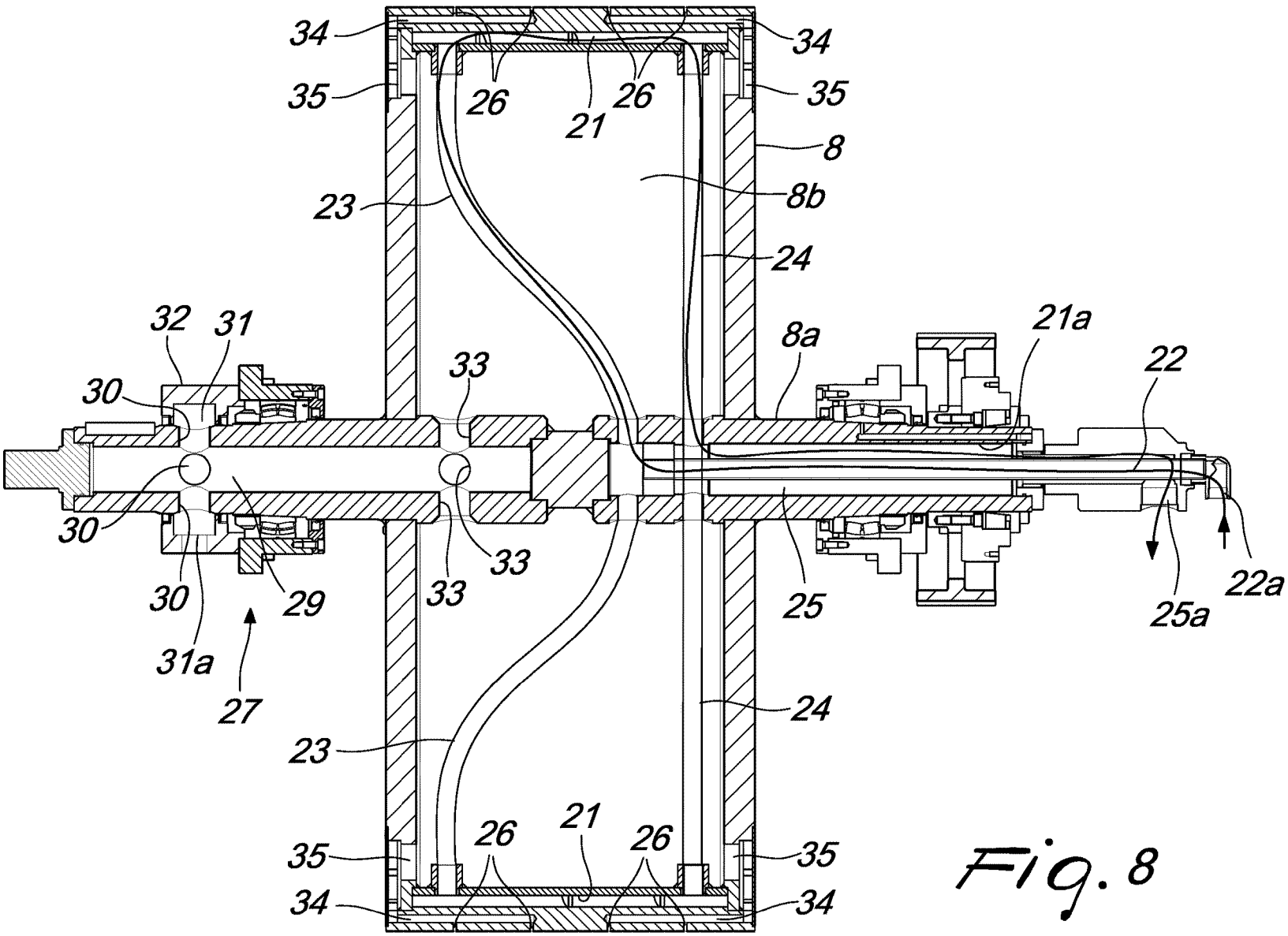
FIG. 8 is a diametrical cross-section of the drum according to the invention.

As can be seen, in particular, in FIG. 8, the drum 8 has, conveniently, in its side wall, at least one channel 21 for conveying a temperature control fluid, which makes it possible to maintain the outer lateral surface of the drum 8 at a constant preset temperature.

In this manner, it is possible to maintain the portion of tape 4 in contact with the drum 8 at a constant temperature, thus allowing the heat transmitted by the curtains of hot air 12 and by the lamps 20 to predominantly heat the ink, making the water contained in it evaporate, and preventing any phenomena of deformation of the tape 4.

For example, as shown in FIG. 8, the temperature control fluid is fed to the conveyance channel 21 by way of a delivery channel 22, which extends axially, inside the supporting shaft 8*a* of the drum 8. In particular, the delivery channel 22 has, substantially at one of its ends, an inlet 22*a*, connected to a device for dispensing the temperature control fluid, not shown, and is connected, at its opposite end, to the conveyance channel 21, by way of at least one flexible delivery pipe 23, accommodated in an inner cavity 8*b* of the drum 8.

In order to make it possible to keep the temperature control fluid at constant temperature, the output of the conveyance channel 21 is, further, connected to the dispensing device, through, for example, a flexible exit tube 24, arranged in the inner cavity 8*b* of the drum 8 and connected to a return channel 25 of the temperature control fluid, which extends inside the supporting shaft 8*a* of the drum 8, coaxially to the delivery channel 22, and which leads into an outlet 25*a* that is connected, in turn, to the device for dispensing the temperature control fluid.

Preferably, the means of adhesion of the tape 4 to the drum 8 are provided by a plurality of openings 26 defined at the outer lateral surface of the drum 8 and connected to air aspiration means 27, which make it possible to ensure an optimal retention of the tape 4 in adherence to the drum 8.

In this manner, the speed of the curtains of hot air 12 can be pushed to very high levels without generating transverse or longitudinal skidding of the tape 4 and, more generally, the pressure generated by the hot air emitted by the emitter means 9 does not cause unwanted shifts of the tape 4, since the latter remains perfectly placed on the outer lateral surface of the drum 8.

Furthermore, the aspiration of air at the outer lateral surface of the drum 8 through the openings 26 makes it possible to eliminate any bubbles of air drawn between the tape 4 and the drum 8, especially at the high advancement speeds of the tape.

Figure 2:
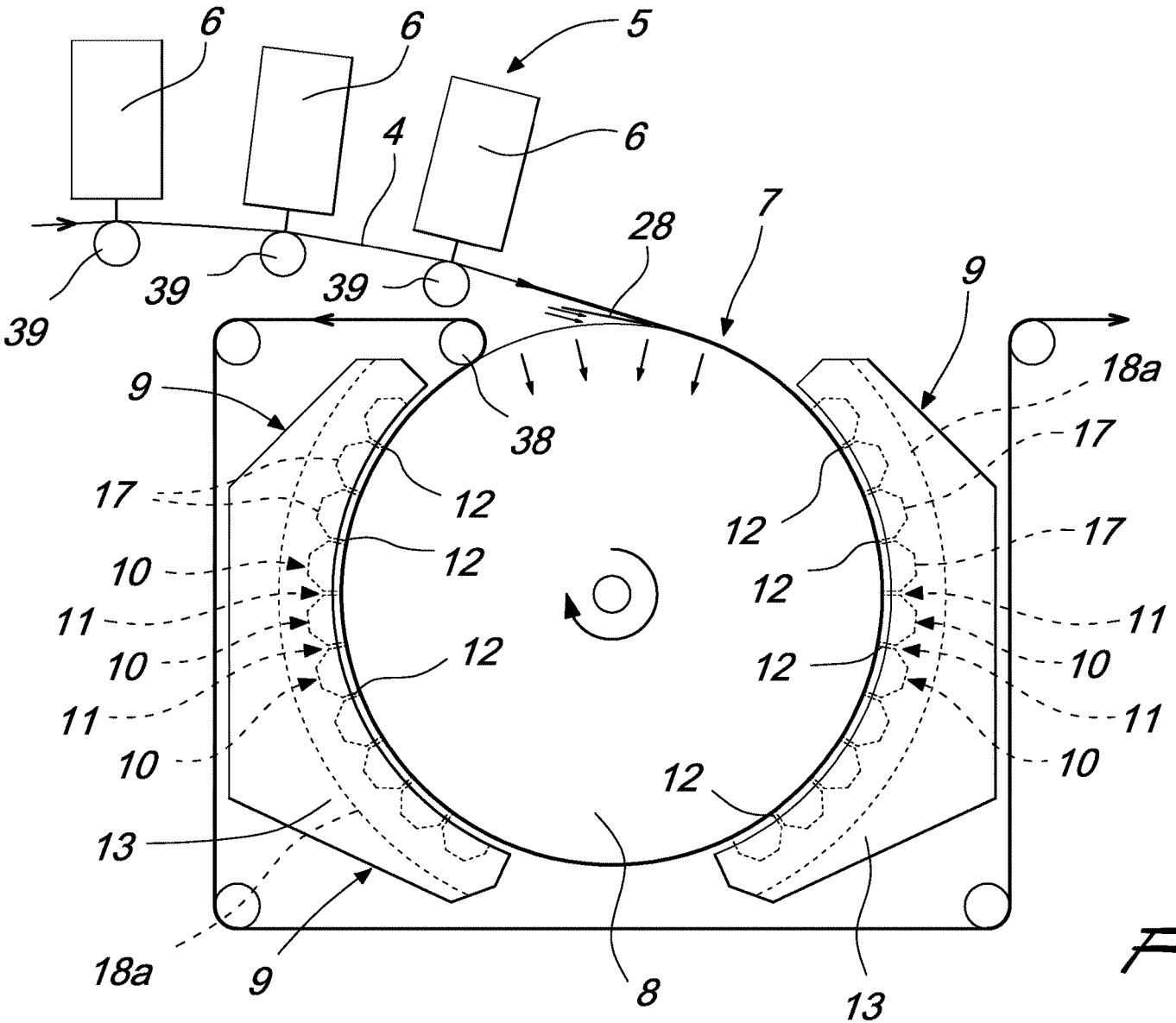
FIG. 2 is a schematic side view of a portion of the machine according to the invention in a possible embodiment thereof.

Optionally, in order to prevent a suction effect on the tape 4, which could lead to an unwanted deformation of the tape, substantially at the region where the tape 4 comes into contact with the drum 8, there can be a lamina 28 for deflecting the air, as shown in FIG. 2.

For example, according to the embodiment shown in FIG. 8, the air aspiration means 27 comprise a vacuum pump, not shown, which is connected to the openings 26 by way of an aspiration channel 29 that extends axially inside the supporting shaft 8*a*, conveniently in a portion thereof that is opposite the portion where the return channel 25 and the delivery channel 22 of the temperature control fluid are defined.

In particular, the aspiration channel 29 has, for example, substantially at one of its ends, a plurality of openings 30 for extracting air which are distributed about the axis of the supporting shaft 8*a* and are connected to an aspirating chamber 31, which is defined by a sleeve 32, arranged around the supporting shaft 8*a*, and connected, by way of a connection opening 31*a*, to the vacuum pump.

The aspiration channel 29 has, further, substantially to its opposite end, a plurality of air entry openings 33 which are distributed about the axis of the supporting shaft 8*a* and are connected to the inner cavity 8*b* of the drum 8. The openings 26 are, in turn, connected to the inner cavity 8*b* of the drum 8, through aspiration channels 34, which are defined within the side wall of the drum 8, substantially parallel to its outer lateral surface, and which are connected with connecting chambers 35, which are defined substantially at the axial faces of the drum 8 and are open toward the inner cavity 8*b* of the drum proper.

It must be pointed out that a gearwheel 37 for the rotational actuation of the drum 8 can, conveniently, be keyed, for example on the opposite side with respect to the sleeve 32, on the supporting shaft 8*a* of the drum 8.

Conveniently, the means of adhesion of the tape 4 to the drum 8 can comprise at least one presser roller 38, conveniently rubberized, which is substantially parallel to the drum 8 and adapted to engage the tape 4 on the opposite side with respect to the drum proper.

As in the embodiments shown, in particular, in FIGS. 2 and 3, each one of the printing heads 6 of the printing assembly 5 can be facing a respective roller 39 for supporting the tape 4.

Figure 4:
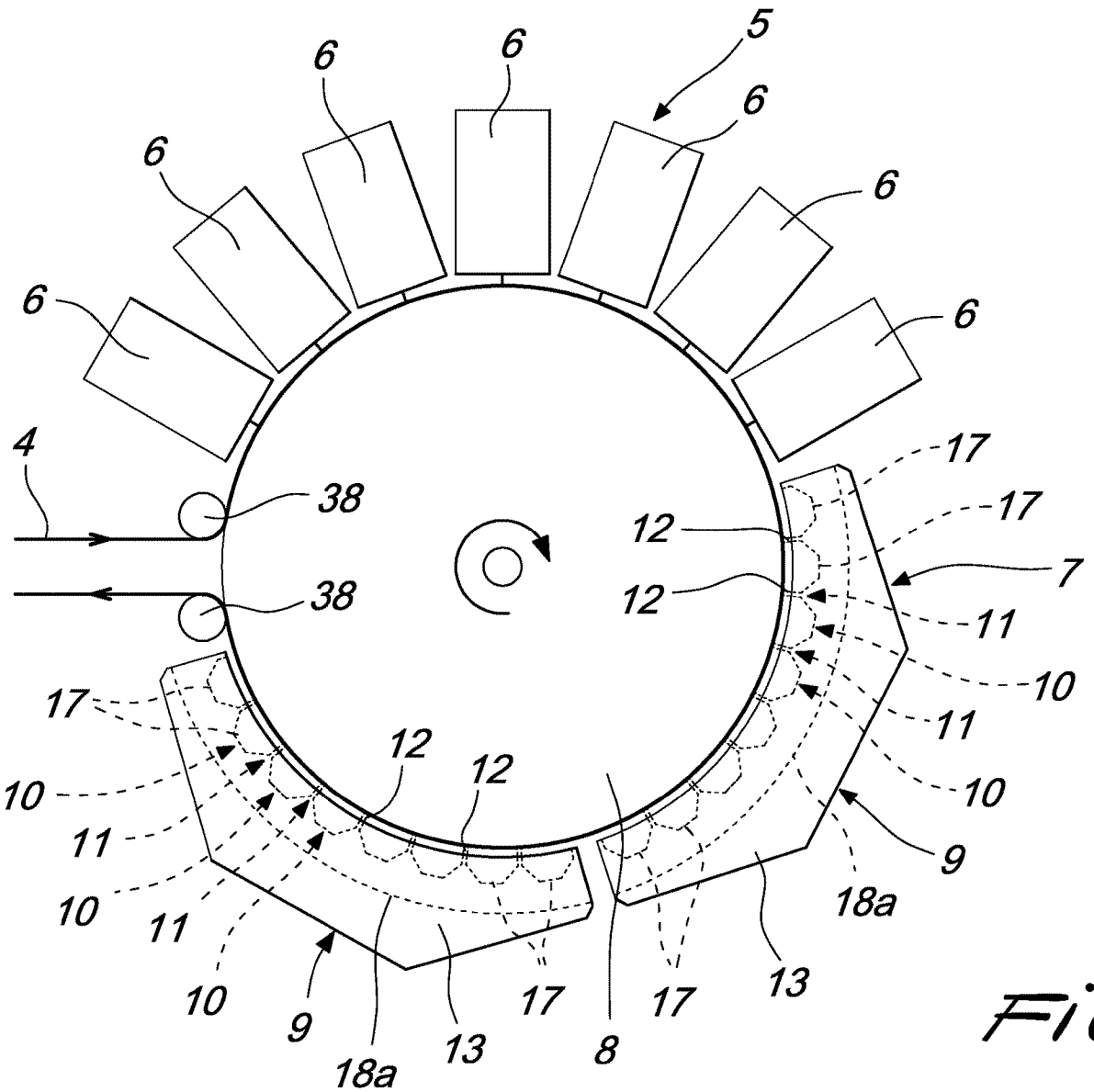
FIG. 4 is a side view of a portion of the machine according to the invention in a third embodiment.

Alternatively, as shown in FIG. 4, it is also possible to have the printing heads 6 arranged facing toward the drum 8.

In this case, the means of adhesion of the tape 4 to the drum 8 can, conveniently, be provided by least two presser rollers 38, one positioned upstream of the printing heads 6, in the region of initial contact between the drum 8 and the tape 4, and one positioned in the region of separation of the tape 4 from the drum 8, since, in this embodiment, the presser roller 38 upstream of the printing heads 6 cannot press on the tape 4 which is still wet from the inks, as it would damage the print.

It should be noted that there can be, conveniently, an unwinding support 40 mounted on the frame 2 for unwinding a spool 41 of tape 4 to be printed, located upstream of the printing assembly 5, along the advancement direction of the tape 4, and a winding support 42 for winding the spool 43 of the printed tape 4, placed downstream of the drum 8, also along the advancement direction of the tape 4.

Operation of the machine according to the invention is the following.

The tape 4 is made to advance by the entrainment means and the print heads 6 apply the printing inks on the tape 4.

Once it has come into contact with the drum 8, by virtue of the means of adhesion, the tape 4 is kept at a constant temperature, by virtue of the circulation of the temperature control fluid inside the conveyance channel 21 defined in the side wall of the drum 8.

The tape 4, entrained by the drum 8, passes through the hot air emitter means 9, so as to be struck by the curtains of hot air 12 produced by the generator means 11, and, at the same time, it can be, further, also struck by the heat produced by the lamps 20, while the hot air emitted by the emitter means 9 is evacuated, together with the water removed from the inks, by the aspiration hoods 17.

The tape 4, once it has left the drum 8 behind, can be sent for subsequent processing or wound by the winding support 42 in a spool 43 of printed tape.

In practice it has been found that the invention is capable of fully achieving the set aim and objects and, in particular, attention is drawn to the fact that the present invention makes it possible to achieve high-speed printing of water-based inks on tape that is substantially not absorbent.

Another advantage of the invention is the high precision of printing, since the tape is stably kept in adhesion on the drum, even with the dispensing of hot air at high speed.

Another advantage of the invention is that it permits a high capacity of drying of water-based inks.

All the characteristics of the invention, indicated above as advantageous, convenient or similar, may also be missing or be substituted by equivalent characteristics.

The individual characteristics set out in reference to general teachings or to specific embodiments may all be present in other embodiments or may substitute characteristics in such embodiments.

The invention, thus conceived, is susceptible of numerous modifications and variations, all of which are within the scope of the appended claims.

In practice the materials employed, provided they are compatible with the specific use, and the dimensions and shapes, may be any according to requirements.

Moreover, all the details may be substituted by other, technically equivalent elements.

The disclosures in Italian Patent Application No. 102016000055944 (UA2016A003958) from which this application claims priority are incorporated herein by reference.

The invention claimed is:

1. A machine for digital printing on tape, which comprises: a frame that supports means of entraining at least one tape along an advancement path and is provided with at least one printing assembly, which comprises at least one ink-jet printing head, downstream of said printing assembly, along the advancement direction of said tape, there being at least one assembly for drying inks applied to said tape, wherein said drying assembly comprises: a temperature-adjustable drum for supporting and entraining said tape, wherein said drum has, in a side wall thereof, at least one channel for conveying a temperature control fluid, adhesion means adapted to allow the retention in adhesion of said tape on an outer lateral surface of said drum, wherein said adhesion means comprise a plurality of openings defined at the outer lateral surface of said drum and connected to further aspiration means in order to ensure a retention of said tape in adherence to said drum, hot air emitter means which face at least one portion of the outer lateral surface of said drum and further comprising a plurality of aspiration channels wherein the plurality of aspiration channels are defined within the side wall of the drum, and wherein the plurality of aspiration channels are substantially parallel to the outer lateral surface of the drum.

2. The machine according to claim 1, comprising aspiration means of aspirating hot air emitted by said emitter means, said aspiration means facing at least one portion of the outer lateral surface of said drum.

3. The machine according to claim 2, wherein said emitter means comprise means of generating curtains of hot air, which are arranged mutually spaced apart around an axis of said drum.

4. The machine according to claim 3, wherein said emitter means comprise a feeder manifold for feeding hot air, which is connected to a hot air source and extends around at least one portion of the outer lateral surface of said drum, said feeder manifold being connected, at regular intervals along its extension, to said means of generating curtains of hot air.

5. The machine according to claim 2, wherein said aspiration means are interleaved between said means of generating curtains of hot air.

6. The machine according to claim 4, wherein said means of generating curtains of hot air comprise a plurality of dispensers which are mutually spaced apart around the axis of said drum and are each provided with at least one respective blower slit which is connected to said hot air feeder manifold, said blower slit extending substantially parallel to the axis of said drum and facing the outer lateral surface of said drum.

7. The machine according to claim 6, wherein said aspiration means comprise a plurality of aspiration hoods which are interposed between said dispensers and are open toward the outer lateral surface of said drum, said aspiration hoods having an extension that is substantially parallel to the axis of said drum.

8. The machine according to claim 7, wherein said aspiration hoods are connected, at at least one of their longitudinal ends, to an aspiration fan.

9. The machine according to claim 7, further comprising heating means adapted to emit infrared radiation.

10. The machine according to claim 9, wherein said heating means comprise a plurality of infrared lamps, each one arranged inside a respective aspiration hood.

11. The machine according to claim 1, wherein said adhesion means comprise at least one presser roller that is substantially parallel to said drum and is adapted to engage said tape on the opposite side with respect to said adjustable drum.

12. The machine according to claim 1, wherein said at least one printing head faces the outer lateral surface of said drum.

13. The machine according to claim 1, wherein each one of said printing heads faces a respective roller for supporting said tape.

14. The machine according to claim 1, further comprising a plurality of connecting chambers defined substantially at the axial faces of the drum and are open toward an inner cavity of the drum.

15. The machine according to claim 1, further comprising a plurality of connecting chambers defined substantially at the axial faces of the drum and are open toward the inner cavity of the drum.

16. The machine according to claim 15, wherein the plurality of openings are connected to an inner cavity of the drum through both the plurality of aspiration channels and the plurality, of connecting chambers.

* * * * *